United States Patent [19]

Eberhart

[11] Patent Number: 5,018,229

[45] Date of Patent: May 28, 1991

[54] POCKETED BEACH TOWEL

[76] Inventor: Douglas E. Eberhart, P.O. Box 2331, N. Canton, Ohio 44720

[21] Appl. No.: 504,614

[22] Filed: Apr. 3, 1990

Related U.S. Application Data

[63] Continuation-in-part of Ser. No. 103,379, Oct. 1, 1987, abandoned.

[51] Int. Cl.[5] ..... A47G 9/06
[52] U.S. Cl. ..... 5/417
[58] Field of Search ..... 5/417–420, 5/485; D6/595, 596, 602, 603, 608; 190/2

[56] References Cited

U.S. PATENT DOCUMENTS

| | | | |
|---|---|---|---|
| 3,226,737 | 1/1966 | Rote | 5/417 |
| 4,223,056 | 9/1980 | Di Fronzo | 5/417 |
| 4,468,823 | 9/1984 | Tounjian | 5/417 |
| 4,654,906 | 4/1987 | Roberts | 5/417 |
| 4,703,528 | 4/1987 | Rolle | 5/417 |

*Primary Examiner*—Alexander Grosz
*Attorney, Agent, or Firm*—Clifton Ted Hunt

[57] ABSTRACT

A pocketed beach towel includes pockets at the corners and a weight in a sealed package for each pocket. Each pocket also functions as a hidden receptacle for personal effects and valuables by including a closable opening that simulates a permanent closure.

4 Claims, 2 Drawing Sheets

POCKETED BEACH TOWEL

CROSS-REFERENCE TO RELATED APPLICATION

This application is a continuation-in-part of my pending design patent application Ser. No. 103,379, filed Oct. 1, 1987 now abandoned for WEIGHTED BEACH TOWEL.

FIELD OF THE INVENTION

This invention relates to beach towels of the type including weights to keep the towel from being disturbed by the wind.

BACKGROUND OF THE INVENTION

It is known in the prior art to provide a beach towel with weights to prevent the wind from undesirably disturbing the towel. See, for example, U.S. Pat. No. 3,226,737 issued Jan. 4, 1966 to Rote for BEACH AND PICNIC BLANKET. See also U.S. Pat. No. 4,654,906 issued Apr. 7, 1987 to Roberts for BEACH BLANKET WITH SAND POCKETS.

Rote shows a pocket stitched at the edges to each corner of the blanket and opening toward the center of the blanket. According to one embodiment, sand is placed in the pockets to hold the blanket in place. According to another embodiment Rote provides weighted bags (containing sand, rocks, dirt, or the like) releasably secured in the corner pockets by visible snap fasteners, buttons, or the like, indicated at 13 in the Rote patent.

Roberts also shows a triangular pocket to hold sand at each corner of a beach blanket, but each of Roberts' pockets opens outwardly toward the corresponding corner of the blanket and is stitched to the blanket only along its inner edge. The open corners of the pockets are releasably closed by drawstrings fastened to the corner tips of the layers of the pockets.

Rote and Roberts both show closing means for releasably closing pockets that contain weights to keep a beach or picnic blanket in place. The closing means in both patents are highly visible and there is no suggestion in either patent of using the pockets to contain anything other than weights or of structuring the pockets with concealed openings, whereby the pockets may effectively serve as a hidden receptacle for valuables, as well as housing weights to stabilize the towel.

SUMMARY OF THE INVENTION

The pocketed beach towel of this invention comprises a towel from a suitable fabric, such as terry cloth, at least one apparently permanently closed housing or pocket to contain a stabilizing weight, and a packaged weight such as a bag of sand for each pocket. Each such pocket comprises a desirably shaped piece of pocket fabric overlying a corresponding portion of the towel and apparently sewn along its edges to the towel.

At least one edge of the pocket fabric is releasably fastened to the towel as by interlocking strips of a hook and loop fastener sewn respectively to the pocket fabric and to the towel. In use, the stitching along all edges of the pocket fabric gives the appearance that the pocket is an inaccessible housing for sand.

The packaged weight causes the pocket to bulge outwardly, making the stitching all around the pocket more visible and emphasizing the appearance of an inaccessible housing for the sand. Sufficient space is provided within the pocket, however, for the temporary storage of the user's personal effects, such as keys, sunglasses, money, etc. The appearance of a sand housing being permanently closed provides a measure of safety for the personal effects stored in the pocket.

DETAILED DESCRIPTION OF THE ILLUSTRATED EMBODIMENT OF THE INVENTION

Referring more specifically to the drawings, a pocketed beach towel is broadly indicated at 10. In the illustrated embodiment of the invention, the towel 10 is of rectangular configuration and is formed from a suitable fabric 11, such as terry cloth, but it may be of any desired shape and formed from any suitable material within the spirit of the invention.

Figure 7:
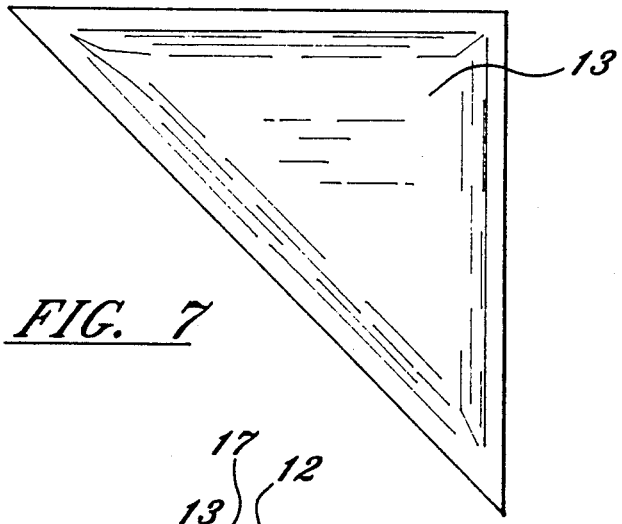
FIG. 7 is a top plan view of a piece of fabric shaped to form the top layer of a pocket.

A pocket 12 is illustrated at each corner of the towel, but one or more of the pockets may be located elsewhere on the towel, as desired, within the spirit of the invention. Each pocket 12 is formed from a single piece of fabric 13 of a desired shape, which may be triangular as shown in FIG. 7. In the illustrated embodiment, the pocket fabric 13 is sewn to the towel fabric 11 by stitches 14, with one edge portion of the pocket fabric 13 being attached by stitches 14 to the hook component 15 of a hook and loop fastener. The loop component 16 of that fastener is sewn by stitches 14 to the towel fabric 11. If desired, the pocket fabric 13 may be completely attached to the towel by releasable fasteners, such as interlocking hook and loop fasteners.

Figure 1:
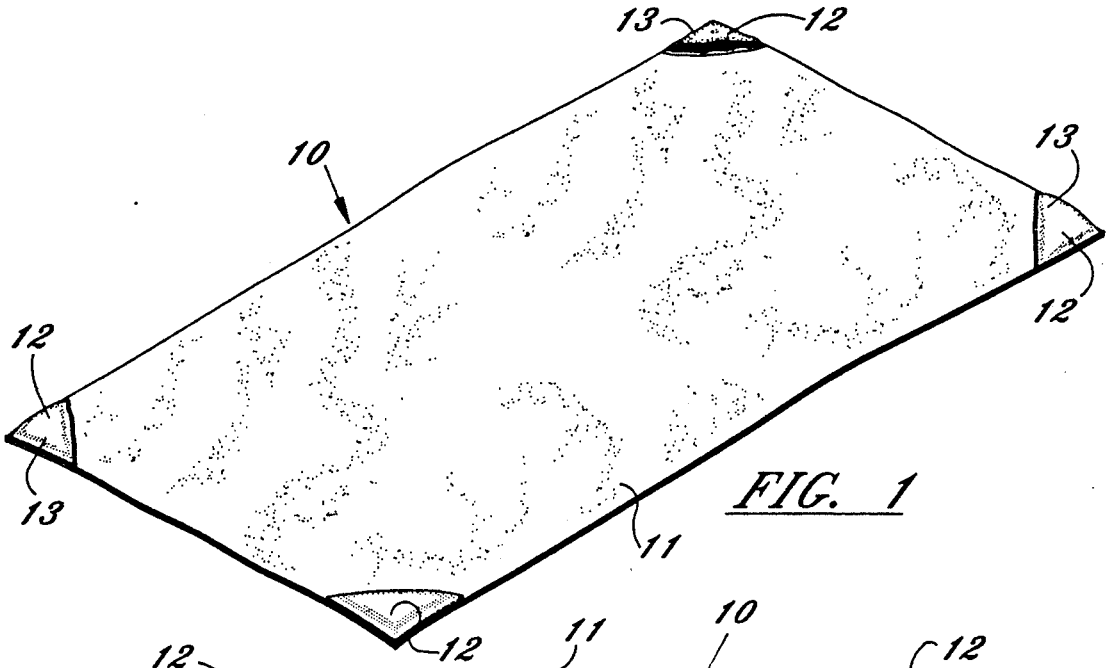
FIG. 1 is a perspective view of the pocketed beach towel.
Figure 2:
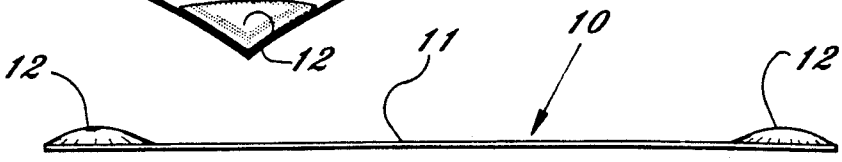
FIG. 2 is an end view of the towel.
Figure 3:
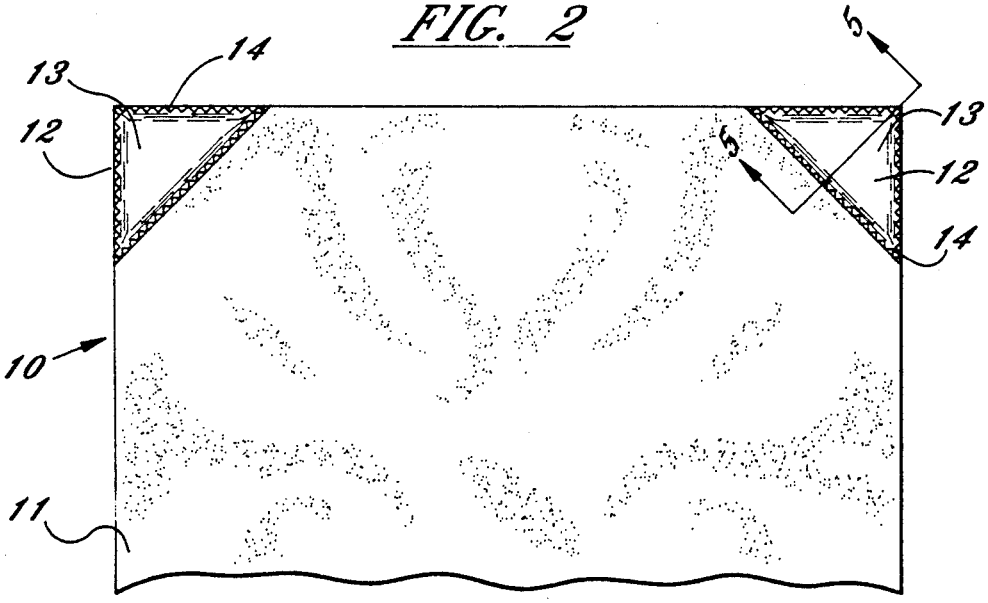
FIG. 3 is an enlarged fragmentary plan view of the towel with parts broken away.
Figure 4:
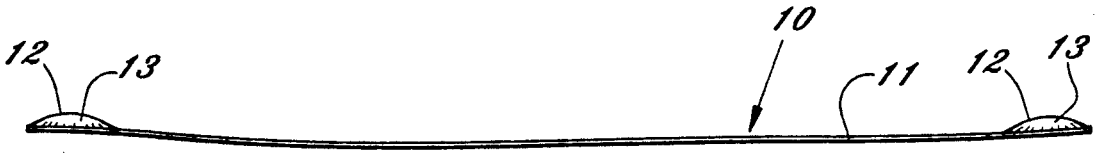
FIG. 4 is a side view of the towel.
Figure 5:
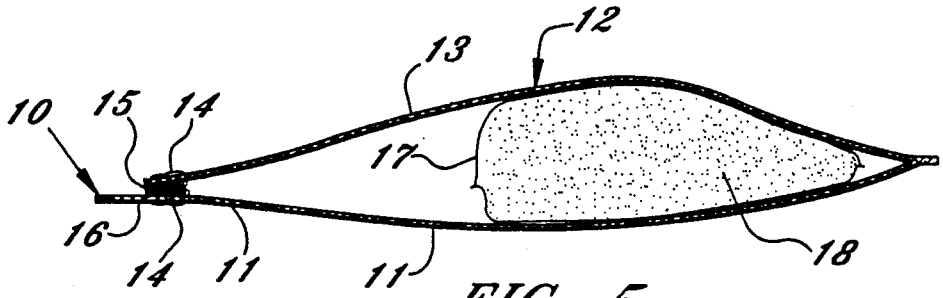
FIG. 5 is a sectional view of a pocket containing a packaged weight and taken substantially along the line 5—5 in FIG. 2.
Figure 6:
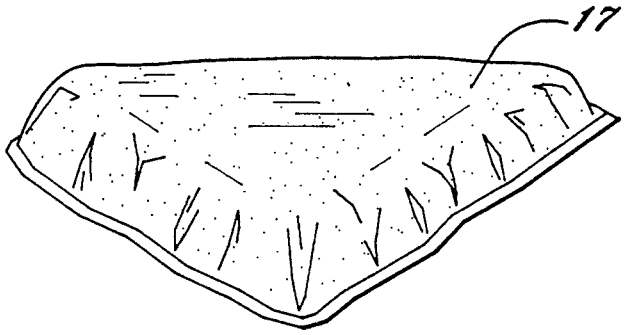
FIG. 6 is a perspective view of a packaged weight removed from the pocketed towel.

A sealed package 17, filled with a suitable weight 18, such as sand, is provided for each pocket 12. In the illustrated embodiment, the package 17 is shown to be triangular in FIG. 6 to conform with the shape of the pocket. The sealed package 17 is easily removed from the pocket 12 when desired, as when the towel 10 is to be washed. The package 17 is preferably shaped to coincide with the shape of the pocket and to cause the pocket fabric 13 to bulge outwardly from the towel fabric 11, as shown in FIGS. 5 and 7. The package 17 is smaller than the pocket to leave an empty space inside the pocket when the package 17 is inserted in the pocket for use. The weight of the package 17 and the outward bulge of the pocket fabric 13 camouflage the empty space within the pocket.

Figure 8:
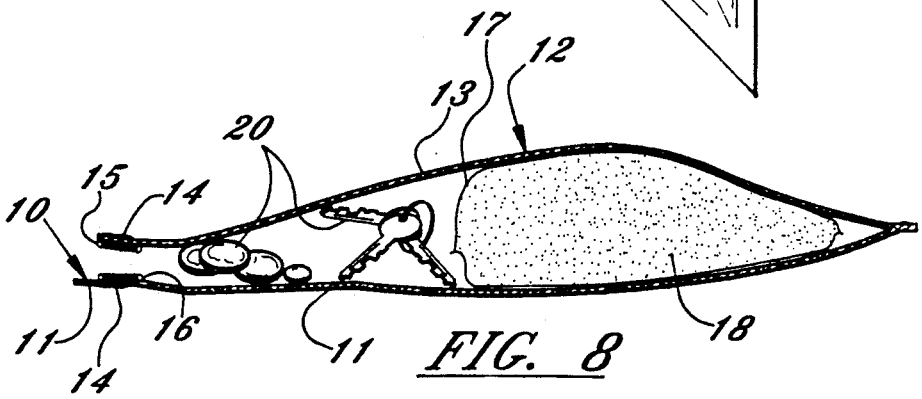
FIG. 8 is a sectional view similar to FIG. 5 but illustrating the storage of personal effects with a packaged weight in a pocket of the towel.

FIG. 8 illustrates the storage of valuables or personal effects, such as money and keys 20 in the camouflaged space remaining within the pocket 12 after the package of sand 18 is in place. The closing of the pocket 12 by interlocking the hook and loop fasteners 15 and 16, as in FIG. 5, leaves the pocket with the appearance of being permanently stitched to the towel.

The weight of the package 17 readily conveys to anyone lifting the towel that the purpose of the pocket is to house a weight to prevent the towel from being disturbed by the wind. The absence of anything to indicate that the pocket can be opened or might contain anything other than the weight provides a measure of safety for the items 20 within the pocket.

There is thus provided a pocketed towel which is effectively stabilized against disturbance by the wind and which has the additional desirable function of providing a choice of hidden receptacles for personal effects and valuables.

Although specific terms have been employed in describing the invention, they have been used in a generic and descriptive sense only and not for the purpose of limitation.

I claim:

1. In a pocketed towel having a towel fabric of rectangular configuration and a pocket fabric of triangular configuration attached in overlying relation along two of its edges to underlying corner edges of the rectangular towel fabric to define a pocket at a corner of the rectangular towel fabric; the improvement comprising a removable packaged weight shaped and sized to fit in the pocket and cause the pocket fabric to bulge outwardly from the towel fabric to form camouflaged space within the pocket for personal effects, and camouflaged separable fastener means releasably attaching the remaining edge of the triangularly shaped pocket fabric to the towel fabric in simulation of a permanent closure, whereby the camouflaged space is available for personal effects to be hidden in the pocket when the towel is in use.

2. A pocketed towel according to claim 1 wherein pocket fabric is attached to each corner of the towel fabric to define a pocket at each corner of the towel fabric.

3. A pocketed towel according to claim 1 wherein the pockets are formed by stitching adjoining edges of the pocket fabric to adjoining edges of the towel fabric.

4. A pocketed towel according to claim 1 wherein the camouflaged means releasably attaching the remaining edge of the pocket fabric to to the towel fabric in simulation of a permanent closure comprises strips of interlocking hook and loop fabric attached to the pocket fabric and to the towel fabric.

* * * * *